United States Patent [19]

Martin

[11] 4,056,143

[45] Nov. 1, 1977

[54] HEAT EXCHANGE APPARATUS

[75] Inventor: Barrie James Martin, Shenfield, England

[73] Assignee: The Plessey Company Limited, Ilford, England

[21] Appl. No.: 675,201

[22] Filed: Apr. 8, 1976

Related U.S. Application Data

[63] Continuation-in-part of Ser. No. 411,135, Oct. 30, 1973, abandoned.

[30] Foreign Application Priority Data

Nov. 8, 1972 United Kingdom ..... 51451/72

[51] Int. Cl.[2] ..... F24B 5/02; F28F 1/32; F28F 9/02

[52] U.S. Cl. ..... 165/176; 122/338; 122/367 R; 165/125; 165/151; 165/171

[58] Field of Search ..... 122/338, 367 PF, 367 R; 165/125, 151, 171, 175, 176

[56] References Cited

U.S. PATENT DOCUMENTS

| | | | |
|---|---|---|---|
| 408,708 | 8/1889 | Gordon et al. | 122/338 |
| 966,980 | 8/1910 | Albrecht | 122/367 PF |
| 1,815,570 | 7/1931 | Jones | 122/367 PF |
| 2,469,635 | 5/1949 | Dalin et al. | 165/171 X |
| 2,620,170 | 12/1952 | Brickman | 165/151 X |
| 2,970,814 | 2/1961 | Floreen | 165/171 |
| 3,159,213 | 12/1964 | Wurtz | 165/171 |
| 3,302,705 | 2/1967 | Witten, Jr. | 165/125 X |
| 3,315,646 | 4/1967 | Witten, Jr. | 122/367 R |

FOREIGN PATENT DOCUMENTS

| | | | |
|---|---|---|---|
| 747,402 | 4/1956 | United Kingdom | 165/177 |
| 452,231 | 7/1935 | United Kingdom | 165/151 |

*Primary Examiner*—Ronald H. Lazarus
*Assistant Examiner*—Sheldon Richter
*Attorney, Agent, or Firm*—Scrivener, Parker, Scrivener & Clarke

[57] ABSTRACT

A heat exchanger for central heating in which water to be heated passes through a circular array of parallel tubes. Hot gas passes over the outside of the tubes and heats the water up. Metal wire interlaces the tubes and helps conduction heat from the gas to the water. Preferably the arrangement of tubes and wires is metal coated to further help the heat conduction.

6 Claims, 3 Drawing Figures

HEAT EXCHANGE APPARATUS

This application is a continuation-in-part of pending prior application Ser. No. 411,135 filed Oct. 30, 1973 by Barrie J. Martin, for Heat Exchanger Apparatus now abandoned.

This invention relates to heat exchange apparatus of the kind in which it is desired to transfer heat from one fluid to another fluid. Typical examples of such heat exchange apparatus are boilers for central heating systems and chemical heat exchange units.

Although many types of heat exchange apparatus are known, there is always a desire to reduce the overall size of the apparatus to facilitate its installation into relatively small spaces in, for example, domestic kitchens. It is also desirable that the heat exchange apparatus should be robustly constructed and capable of heating a fluid, e.g. a liquid, to high temperatures. It is an aim of this invention to provide such heat exchange apparatus.

Heat exchange apparatus in accordance with the invention comprises a fluid conducting array of one or more fluid flow conduits so constructed that at least portions of the array are substantially parallel to one another, and heat conducting elongate or porous sheet material in contact with at least the parallel portions of the array.

Preferably, the fluid conducting array is comprised by a plurality of separate fluid flow conduits. However if desired, the fluid conducting array could be comprised by a single conduit bent to give a repeating sine wave shape. Usually, the fluid flow conduits will be pipes of, preferably, circular cross-section. The pipes may be connected to a common upper chamber and a common lower chamber. The upper and lower chambers may be so partitioned that fluid from the lower chamber can pass up through a first batch of the pipes and into the upper chamber, back through a second batch of the pipes and into the lower chamber, up through a third batch of the pipes and into the upper chamber, and back through a fourth batch of the pipes and into the lower chamber.

The heat conducting material preferably passes between the parallel portions of the fluid conducting array and thereby acts to interrupt the flow of fluid over the outer surface of the array. This fluid is thus in a turbulent state and this is advantageous in enabling good heat transfer between the first fluid in the fluid conducting array and a second fluid flowing over the outside of the array. Also, the heat conducting material increases the surface area over which heat can be transferred. Usually, a hot fluid will pass over the outside of the fluid conducting array and the heat from this fluid will be transferred to a cold fluid passing through the array. In boilers for central heating systems, the hot fluid will usually be a gas and the cold fluid will usually be water.

The elongate heat conducting material is preferably metal wire, for example of circular cross-section. Alternatively, the elongate heat conducting material may be metal braid or flat strip. The heat conducting porous sheet material may be woven metal or gauze sheet. Examples of metals that can be used are copper, steel and various alloys.

When the heat conducting material is in position around the fluid conducting array, the whole arrangement is then metal coated by, for example, dip soldering or metal spraying. The metal coating forms a seal at the points where the heat conducting material touches itself and the fluid flow conduits and thus forms good heat conducting paths between the fluid flow conduits and the heat conducting material.

The heat conducting material, e.g. wire, may be so interlaced or woven around the parallel portions of the fluid conducting array that it passes over a parallel portion, under the next two portions, over the next portion, under the next two portions, and so on right around the array. In another configuration, the heat conducting material may pass over one parallel portion of the array, under the next portion, over the next portion, under the next portion, andd so on right around the array. Other interlacing configurations may be employed if desired.

The fluid conducting array may be constructed in various designs although it will usually be circular, square or rectangular in overall shape.

In order to further facilitate transference of heat between the fluid passing through the array and the fluid passing over the array, any large axial interstices in the whole arrangement of the fluid conducting array and the heat conducting material may be filled with solid material which acts as a baffle. The solid material is brazed, welded, soldered or otherwise permanently joined to the heat exchange apparatus, e.g. by the aforementioned dip soldering. The solid material may be in particulate, ball, or rod or angle form. Typical examples of the presently preferred solid materials are most types of non-rusting metals such for example as copper, stainless steel and aluminium. In addition to the solid material having a high heat transfer coefficient, it should also not melt or otherwise prematurely disintegrate under the working temperatures of the heat exchange apparatus. Similar criteria also clearly apply to the choice of material for the fluid flow conduits.

When the hot fluid is a hot gas, e.g. natural gas, pressure regulating means may be employed to ensure that the gas is always delivered to the burner at the desired constant pressure. This provision of gas pressure regulating means is especially desirable where natural gas is being employed since mains pressure variations sometimes occur.

The heat exchange apparatus of the invention may include ignition means for igniting the gas. The gaseous fluid may be constituted by a mixture of the aforesaid air and natural gas. Gases other than natural gas may of course be employed if desired but natural gas is presently preferred because it is readily available to the majority of the industrial and domestic dwellings. In order to ensure that sufficient air is mixed with the natural gas, the heat exchange apparatus will usually include a fan for drawing air into the apparatus for admixture with the natural gas prior to ignition. Flame blow-back preventing means may be employed in case the ignited gaseous material should try to burn in undesirable parts of the apparatus.

The gases may be arranged to burn continuously but at varying strengths in order to exercise some control over the amount of gas ignited, thereby indirectly controlling the temperature of a fluid being heated. Alternatively, the gas may be turned on and off as required, for example by an appropriate thermostat, in order to keep the fluid to be heated at a desired temperature. Typical examples of appropriate ignition means are spark igniters and gas pilot lights.

Hot waste fluids emitted from the apparatus of the invention may be recirculated to assist in furthering the heating process. Also, the exterior of the heat exchange apparatus may be provided with appropriate insulation to minimise heat losses.

Where the heat exchange apparatus of the invention is used in central heating systems, it will be provided with appropriate flues and will be connected to appropriate radiators in the usual manner.

A typical embodiment of the invention will now be described by way of example and with reference to the accompanying drawings, in which.

Figure 1:
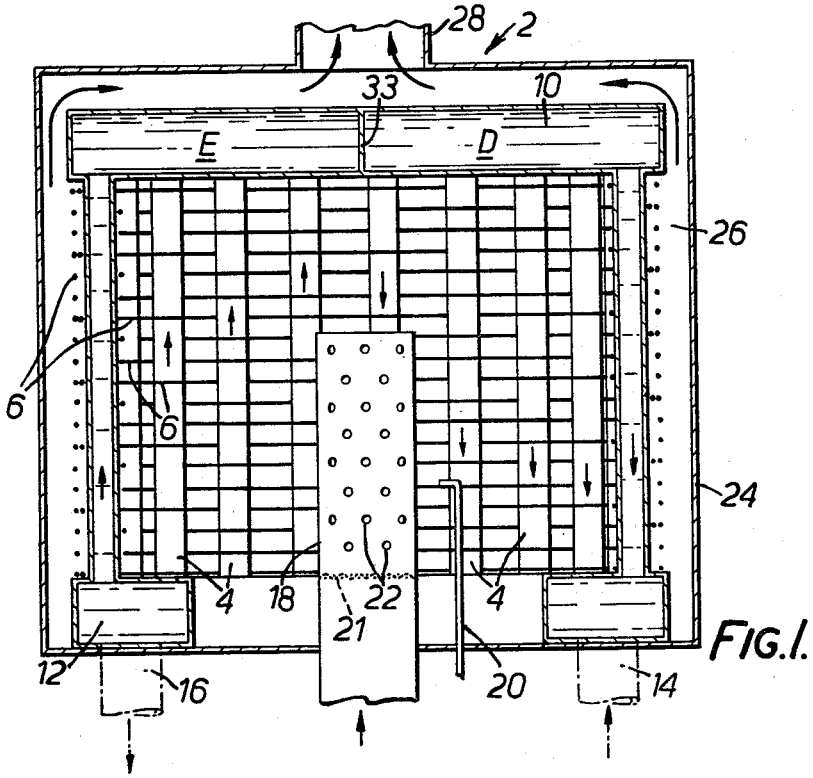
FIG. 1 is a longitudinal section through one form of heat exchange apparatus in accordance with the invention and in which some vertical pipes have been omitted for clarity.
Figure 2:
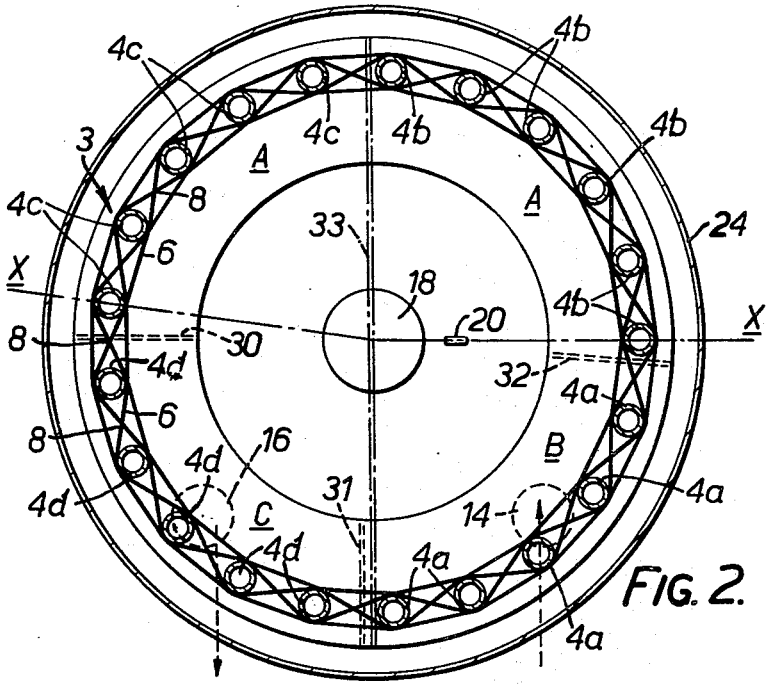
FIG. 2 is a partial cross section through the heat exchange apparatus of FIG. 1 and especially illustrates one preferred type of wire interlacing or weaving.

Referring to FIGS. 1 and 2, there is shown heat exchange apparatus 2 comprising a fluid conducting array 3 (FIG. 3) of parallel fluid flow pipes 4. The fluid conducting array 3 is cylindrical in shape and the pipes 4 are interlaced by wire 6. As shown most clearly in FIG. 2, the various lengths or runs of wire each pass over the outside of one pipe 4, pass over the inside of the next two pipes, 4, pass over the outside of the next pipe 4, pass over the inside of the next two pipes 4 and so on around the array 3. With this arrangement, a fairly solid or continuous surface is formed on the inside of the array and an adequate number of wire cross-over points 8 are formed between the inside and outside of the array 3. As a final step in the positioning of the wire 6 around the array 3, more wire 6 is wound around the outside of the array 3 to give a fairly solid or continuous outer surface. The whole arrangement of the array 3 and wire 6 is soldered to give good heat conducting paths between the wire 6 and the pipes 4. The soldering is effected by providing a copper paste on the array 3 and wire 6 and then placing the pasted array and wire in a furnace. The wiring may be effected by placing each tube 4 on a mandrel (not shown) on a base plate and systematically placing the wire 6 around the pipes 4. The final product is thus a solid soldered device that will still allow the passage of gas through small holes in the weave formed by the wire 6.

The pipes 4 are in communication with an upper chamber 10 and annular lower chamber 12. The lower chamber 12 is divided into three sections A, B, C, by means of three plates 30, 31, 32. The upper chamber 10, which extends across the top of the apparatus 2, is divided into two parts D and E by means of a plate 33. The lower chamber 12 is also provided with a fluid inlet 14 and a fluid outlet 16.

The apparatus 2 includes a combustion chamber 18 made for example of gauze, and a gas igniter 20. The walls of the combustion chamber 18 constitute a flame holder and they are provided with apertures 22 through which the gases to be ignited escape. A gauze flame trap 21 is positioned in the combustion chamber 18 as shown. A housing 24 surrounds the arrangement of the array 3 and wire 6 and defines a chamber 26.

In operation of the apparatus 2 in a central heating system, the fluid to be heated will be water and the hot fluid giving heat to the water will be gas. The water enters the apparatus 2 through the inlet 14 and passes along those tubes 4*a* in the section B of the lower chamber 12 to the section D of the upper chamber 10. The water in the section D of the upper chamber 10 cannot pass to the section E because of the plate 33. The water therefore has to pass along those pipes 4*b* which communicate with the section A in the lower chamber 12. The water in section A of the lower chamber 12 is confined therein by means of the baffles 30 and 32 and it can only pass along those pipes 4*c* which lead the water back to the upper chamber 10 but this time in the section E. The water in the section E can now only escape by passing along the pipes 4*d* to the section C in the lower chamber 12. The water in this section C then flows out of the apparatus 2 via the outlet 16.

During the time that the water is passing through the apparatus 2, a mixture of natural gas and air is introduced into the combustion chamber 18 from where it passes through the apertures 22 and is ignited by means of the igniter 20. The walls of the chamber 18 act as to retain the flame of the ignited gas and air around their outside and a flame trap 21 made of gauze acts to prevent any flame blow back from within the chamber 18. The hot gases pass around both sides of the array 3. They pass through the holes in the wire weaving between the pipes 4 and enter the chamber 26 from where they finally leave the apparatus 2 (if they are now recirculated) through an exhaust 28. In this manner, the water in the array 3 is heated by the hot gaseous mixture passing around the outside of the tubes.

Figure 3:
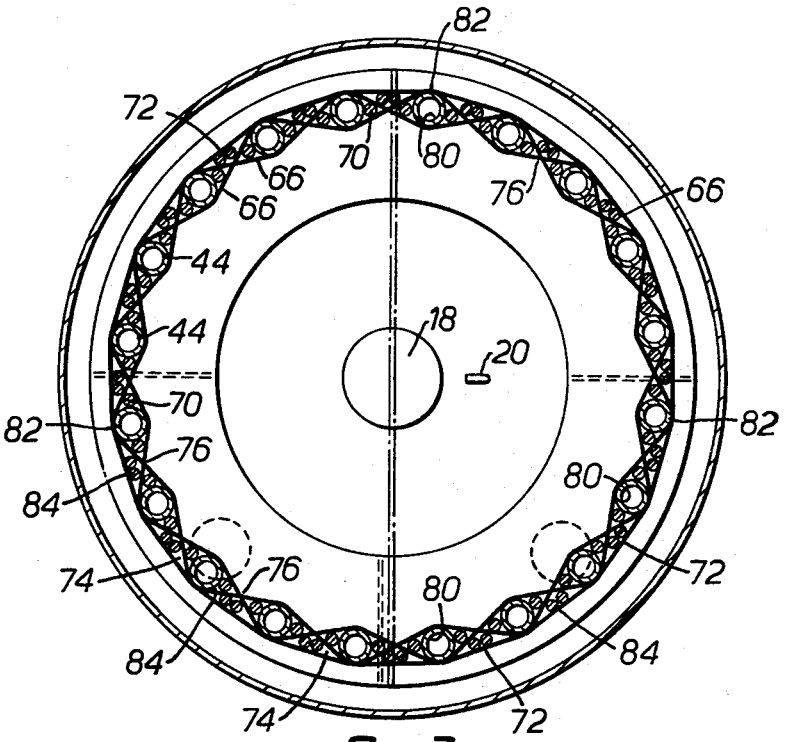
FIG. 3 is a partial cross section like that of FIG. 2 and showing another preferred type of wire interlacing or weaving.

Referring now to FIG. 3, there is shown a pipe array which is similar to that shown in FIG. 2. However, in FIG. 3, wire 66 is passed around each pipe 44 to give the weaving pattern shown. More wire 66 is then wound continuously around the outside of the pipe 44. In order to facilitate optimum transfer of heat between the hot gases passing around the outside of the pipes 44 and the water passing through the pipes 44, heat exchange rods 70 are provided as shown. The arrangement shown in FIG. 3 is brazed with copper in the same manner as the arrangement shown in FIG. 2. Thus the wire 66 is stuck to itself, the pipes 44 and the rods 70. Small holes are left in the woven wire arrangement which allow the hot gases to flow around the pipes 44 and transfer their heat to the water inside the pipes.

The heat exchange apparatus 2 can be so compactly constructed that it is only 6.5 inches in diameter and 5 inches deep. Yet such apparatus may give an output of 55,000 BTU/Hr which represents an 80% efficiency.

In the preferred embodiment of the invention further deflector means in the form of rods 72 (see FIG. 3) are positioned in the spaces 74 formed between the external ring of wire 66 and the wire crossover points 76.

The arrangement shown in FIG. 3 is especially advantageous in that it enables a programmed heat release to be obtained. More specifically, the water in the pipes 44 is heated firstly by means of heat radiated from the combustion chamber 18 and secondly by heat picked up by the wire 66 and the rods 70 and 72. Obviously, the inner part 80 of the pipes 44 will be hotter than their outer part 82 since the inner part 80 is nearer to the combustion chamber 18. Less heat is thus required at the inner parts 80 of the pipes 44 and progressively more heat is required at the sides 84 and the outer parts 82 of the pipes 44 in order to insure that the pipes are substantially uniformly heated.

Thus, as shown in FIG. 3, the radiated heat from the combustion chamber 18 will initially strike the inner parts 80 of the pipes 44 and at this point, in a single plane, there is only one wire 66 touching the pipes 44. Towards the sides 84 of the pipes 44, the pipes will be fractionally cooler and the wire crossover points 76 and the rods 70 are provided to pick up heat from the combustion chamber 18 and transfer this heat to water in the pipes 44. Towards the outer parts 82 of the pipes 44, where the pipes 44 will be cooler still, there is additionally provided the rods 72 which will also be effective to give up their heat. Thus an increasing amount of heat conductive material is positioned as the parts of the pipes get further and further away from the combustion chamber 18. This, as indicated above, ensures that the pipes 44 are as uniformly heated as possible. The situation is avoided where too much heat is picked up by the pipes over their inner parts 80. If too much heat is picked up then localized boiling may occur in the pipes 44 and heat bubbles may be formed. Appreciable noise may be generated by this local boiling and this is undesirable in domestic central heating apparatus. Also, the localized boiling may lead to pitting of the tubes and this is again obviously undesirable.

It is to be understood that the embodiment of the invention described above with reference to the drawing has been given by way of example only and that modifications may be effected. Thus, for example, further baffles can be inserted in the V-shapes formed by the wire 66 on the outside of the circular array of tubes 44 shown in FIG. 3. These baffles can be angle lengths which open outwardly and thus assist in deflecting the hot gases passing through the holes between the woven wire 66 around the pipes 44.

What I claim is:

1. A heat exchange unit for use in a central heating system, which heat exchange unit comprises in combination:

1. a housing;
2. a liquid conducting array of parallel pipes so arranged as to enclose an area, said pipes being spaced inwardly of said housing to define a gas chamber between said pipes and said housing;
3. a gas outlet in said gas chamber;
4. upper and lower liquid chambers communicating with said pipes whereby liquid can be passed through said pipes;
5. heat conducting material woven around said pipes with said heat conducting material extending substantially transverse to said pipes and being in contact with said pipes and with itself;
6. a metallic coating on said heat conducting material and said pipes adhering said heat conducting material to said pipes and to itself to form said heating conducting material and said pipes into a solid body having spaces between said heat conducting material and said pipes through which hot gas can pass, whereby in use of said heat exchange unit said hot gas can pass from the center of said liquid conducting array through said spaces and into said gas chamber and out through said gas outlet and heat conducting material passing around said pipes to cross over itself between said pipes, and wherein more heat conducting material is wound around the outside of said pipes, and metal rods are positioned in gaps formed between said pipes and said cross-over points, said rods being adhered to said pipes and to said conducting material by said metallic coating.

2. A heat exchange unit according to claim 1 in which said upper and lower liquid chambers are so partitioned that liquid from said lower chamber can pass up through a first batch of said pipes and into said upper chamber, back through a second batch of said pipes and into said lower chamber, up through a third batch of said pipes and into said upper chamber, and back through a fourth batch of said pipes and into said lower chamber.

3. A heat exchange unit according to claim 1 in which heat deflector means are positioned between said heat conducting material wound around said outside of said pipes and said cross-over points, said heat deflector means being adhered to said pipes and said heat conducting material by said metallic coating.

4. A heat exchange unit according to claim 3 in which said heat deflector means are metal rods.

5. A heat exchange unit according to claim 4 in which said heat conducting material is wire.

6. A heat exchange unit according to claim 5 in which said metallic coating is obtained by dipping in a bath of molten metal.

* * * * *